US007446643B2

(12) United States Patent
Lee et al.

(10) Patent No.: US 7,446,643 B2
(45) Date of Patent: Nov. 4, 2008

(54) RESETABLE OVER-CURRENT AND/OR OVER-TEMPERATURE PROTECTION SYSTEM

(75) Inventors: Yim-Shu Lee, Kowloon (CN); Jianqing Li, Kowloon (CN); Martin Hoi-Lam Chow, Kowloon (CN); Kam-Wah Siu, Kowloon (CN)

(73) Assignee: The Hong Kong Polytechnic University, Hong Kong SAR (CN)

( * ) Notice: Subject to any disclaimer, the term of this patent is extended or adjusted under 35 U.S.C. 154(b) by 233 days.

(21) Appl. No.: 10/995,040

(22) Filed: Nov. 23, 2004

(65) Prior Publication Data

US 2006/0109074 A1 May 25, 2006

(51) Int. Cl.
*H01H 37/52* (2006.01)
*H01H 37/14* (2006.01)
*H01H 37/16* (2006.01)

(52) U.S. Cl. ..... 337/104; 337/36; 337/100; 361/105; 361/106

(58) Field of Classification Search ..... 337/100, 337/104, 167, 36; 361/105, 106
See application file for complete search history.

(56) References Cited

U.S. PATENT DOCUMENTS 3,529,210 A * 9/1970 Yuichi et al. ..... 361/58
3,840,834 A * 10/1974 Obenhaus et al. ..... 337/79
4,092,573 A * 5/1978 D'Entremont ..... 318/783
4,494,314 A * 1/1985 Gell, Jr. ..... 34/368
4,583,146 A * 4/1986 Howell ..... 361/13
5,262,749 A * 11/1993 Kopelman ..... 337/103
5,367,279 A * 11/1994 Sakai ..... 337/104
5,666,254 A * 9/1997 Thomas et al. ..... 361/8
5,737,160 A * 4/1998 Duffy ..... 361/3
5,805,393 A * 9/1998 Thomas ..... 361/6
5,892,429 A * 4/1999 Hofsass ..... 337/377
5,995,350 A * 11/1999 Kopelman ..... 361/103
6,346,796 B1 * 2/2002 Takeda ..... 320/154
6,349,022 B1 * 2/2002 Myong et al. ..... 361/93.1
6,421,216 B1 7/2002 Myong et al. ..... 361/103

(Continued)

FOREIGN PATENT DOCUMENTS

CN 2585242 Y 11/2003

(Continued)

*Primary Examiner*—Anatoly Vortman
(74) *Attorney, Agent, or Firm*—Jacobson Holman PLLC

(57) ABSTRACT

An electrical protection system, which can be connected between an electrical power supply and an electrical load, firstly includes a switch switchable between a normal state in which the switch is electrically connected in series between the power supply and the load such that an operating current passes through the switch and the load, and a fault sate in which the switch is disconnected with the load such that no current passes through the load. The switch switches to the fault state in an over-current or an over-temperature situation. The system further includes a controller operable in an open state when the switch operates in the normal state, in which state the controller is electrically disconnected from the power supply such that no current passes through the controller, or a closed state when the switch operates in the fault state, in which state the controller is electrically connected in series between the switch and the power supply such that a self-holding current passes through the switch and the controller. The controller operates to automatically set the switch to the normal state when the self-holding current is off.

5 Claims, 4 Drawing Sheets

U.S. PATENT DOCUMENTS

| | | | | |
|---|---|---|---|---|
| 6,577,223 | B2 | 6/2003 | Takeda | 337/377 |
| 6,603,385 | B2 | 8/2003 | Kitchens | 337/407 |
| 6,603,649 | B1 | 8/2003 | Mueller et al. | 361/93.3 |
| 6,670,587 | B1 | 12/2003 | DiSalvo | 219/494 |
| 6,703,917 | B2 | 3/2004 | Belenger et al. | 337/376 |
| 2003/0132732 | A1 * | 7/2003 | Thomas et al. | 320/134 |

FOREIGN PATENT DOCUMENTS

| | | |
|---|---|---|
| SG | 200301505-4 | 8/2004 |

* cited by examiner

RESETABLE OVER-CURRENT AND/OR OVER-TEMPERATURE PROTECTION SYSTEM

BACKGROUND

1. Field of the Invention

This invention relates to electrical circuit over-current and/or over-temperature protection.

2. Background of the Invention

Positive temperature coefficient (PTC) devices are widely used in electrical circuit over-current or over-temperature protections. Such examples include U.S. Pat. No. 6,421,216, filed on Apr. 7, 2000, assigned to EWD, LLC and entitled "Resetable Overcurrent Protection Arrangement," and U.S. Pat. No. 6,577,223, filed on Oct. 10, 2001, assigned to Uchiya Thermostat Co., Ltd. and entitled "Thermal Protector." Both are herein incorporated by reference.

A conventional PTC circuit protection system 100 is shown in FIG. 1, connected between an electrical power supply 101 and an electrical load 103. The system 100 generally includes a bimetal switch 105 and a PTC element 107 thermally coupled and electrically connected in parallel. In a normal situation, the bimetal switch 105 is closed, and the operating current bypasses the PTC element 107 and is fed to the load 103 through the switch 105. In an over-current or an over-temperature situation, the bimetal switch 105 is opened. Current now flows through the PTC element 107 to the load 103 and heats up the PTC element 107. The heat generated by the PTC element 107 keeps the bimetal switch 105 in the open state. Furthermore, the resistance of the heated PTC element 107 is very large, and therefore the current through the load is limited to a very small value. Over-current or over-temperature protection is thereby achieved.

However, disadvantages exist with such conventional design in that the small current through the load 103, even in the over-current or over-temperature situation, may cause certain types of load to behave undesirably. For example, such small current may cause a compact fluorescent lamp (CFL) to flicker.

OBJECT OF THE INVENTION

Therefore, it is an object of the present invention to provide an improved electrical circuit over-current and/or over-temperature protection system, in which no current flows through the load when the system operates in the over-current or over-temperature situation, or at least provide the public with a useful choice.

SUMMARY OF THE INVENTION

According to an aspect of the present invention, an electrical protection system, which can be connected between an electrical power supply and an electrical load, firstly includes a switch switchable between a normal state in which the switch is electrically connected in series between the power supply and the load such that an operating current passes through the switch and the load, and a fault state in which the switch is disconnected with the load such that no current passes through the load. The switch switches to the fault state in an over-current or an over-temperature situation. The system further includes a controller operable in an open state when the switch operates in the normal state, in which state the controller is electrically disconnected from the power supply such that no current passes through the controller, or a closed state when the switch operates in the fault state, in which state the controller is electrically connected in series between the switch and the power supply such that a self-holding current passes through the switch and the controller. The controller operates to automatically set the switch to the normal state when the self-holding current is off.

According to a second aspect of the present invention, an electrical protection system, which can be connected between an electrical power supply and an electrical load, including

- a first and a second contact for electrical connection to the power supply;
- a third and a fourth contact for electrical connection to the load, wherein the second and fourth contacts are in direct electrical connection;
- a fifth contact separated from the third contact;
- a PTC element connected between the fifth and second contacts; and
- a bimetal switch with one end in electrical connection with the first contact and the other end switchable between the third and fifth contacts in response to a change in a current therethrough or a temperature thereof such that the current only flows through either the load or the PTC element,
- wherein the PTC element heats up under the current and thereby keeps the switch in contact with the fifth contact, and wherein the PTC element cools down when the current therethrough is off and thereby reverts the switch to be in contact with the third contact.

According to a third aspect of the present invention, an electrical protection system, which can be connected between an electrical power supply and an electrical load, including

- a bimetal strip as a switch operable in a normal and a fault state connecting to a first and a second contact respectively;
- a first PTC element as the first contact, wherein the first PTC element is in contact with the strip when the switch operates in the normal state such that an operating current flows through the strip, the first PTC element and the load, and wherein the first PTC element functions to push the strip away and towards the second contact when a value of the operating current exceeds a rate value;
- a second PTC element functioning as the second contact, wherein the second PTC element heats up under a self-holding current therethrough as the strip operates in the fault state and connects to the second PTC element, and wherein the second PTC cools down when the self-holding current therethrough is off such that the strip returns to be in contact with the first PTC element,
- wherein no current flows through the load when the strip is in connection with the second PTC element.

According to a fourth aspect of the present invention, an electrical protection device includes

- a first electrical pathway connectable to a power source;
- a second electrical pathway connectable to a load;
- a third electrical pathway containing a PTC element; and
- a temperature sensitive switch connected to the first electrical pathway and switchable between the second and third pathways and positioned in thermal proximity to the PTC element.

Other aspects and advantages of the invention will become apparent from the following detailed description, taken in conjunction with the accompanying drawings, which description illustrates by way of example the principles of the invention.

DETAILED DESCRIPTION

Figure 1:
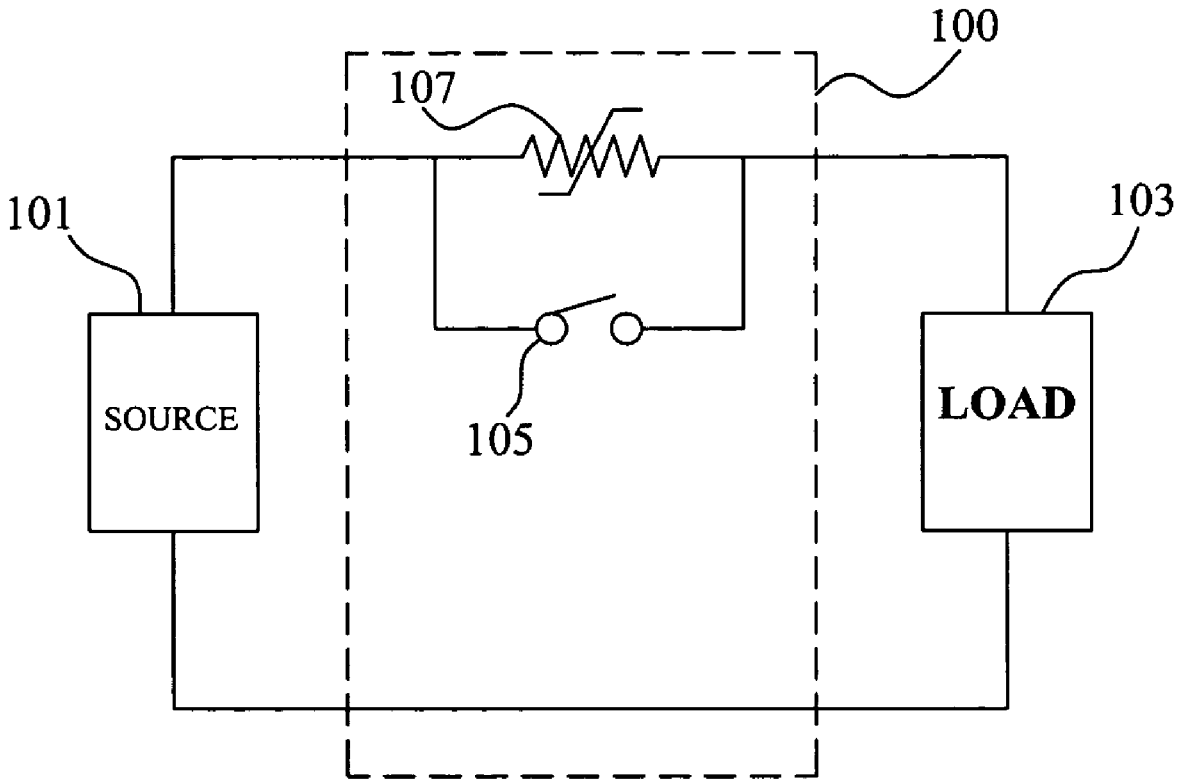
Figure 1 (Prior Art)
FIG. 1 is a diagram illustrating a conventional electrical protection system.
Figure 2A:
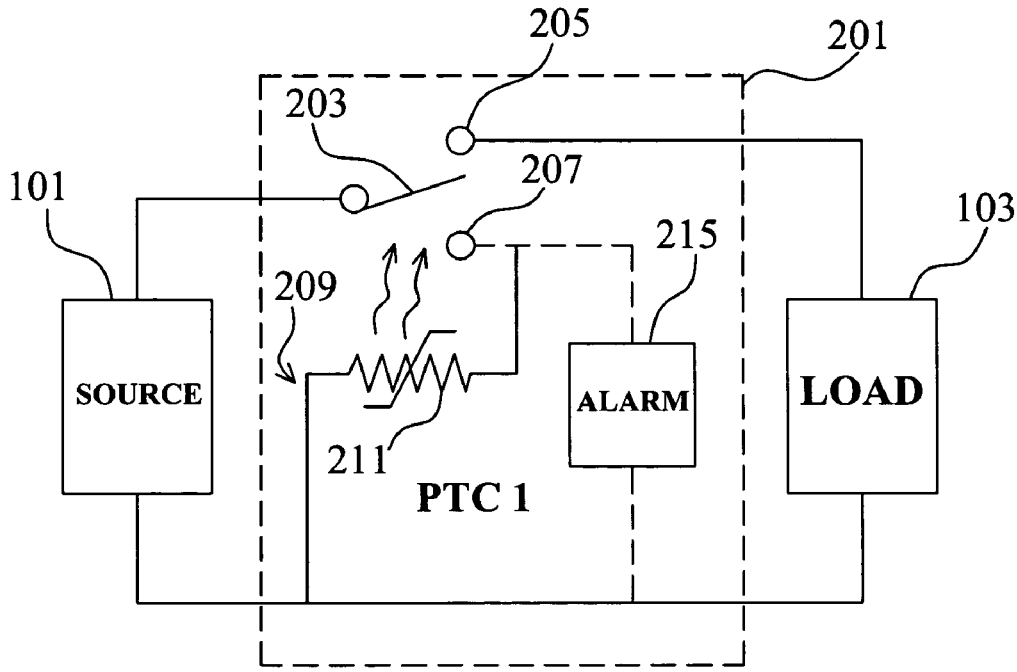
FIG. 2A is a diagram illustrating an exemplary electrical protection system according to the present invention.

FIG. 2A illustrates an electrical protection system 201 according to an exemplary embodiment of the present invention. Similar to the conventional design of FIG. 1, the system 201 is electrically connected between the power supply 101 and the load 103. The system 201 firstly has a bimetal switch 203 switchable between two electrical contacts 205, 207. In a normal state, the switch 203 is switched to the contact 205. In this state, in the exemplary embodiment, the power supply 101, the switch 203 and the load 103 are connected in series such that an operating current passes through the switch 203 and the load 103. The system 201 further has an alternate path 209 including a first PTC element 211 between the electrical contact 207 and the power supply 101. When the current through or the temperature of the bimetal switch 203 is over its respective rated value, the bimetal switch 203 switches to the electrical contact 207 automatically to operate in a fault state such that the switch 203 disconnects the load 103 from the power supply 101. In the fault state, in the exemplary embodiment, the current (so called "self-holding current" in the present application) flows through the switch 203 and the first PTC element 211, without flowing through the load 103. Furthermore, the first PTC element 211 is thermally coupled with the bimetal switch 203. As long as the self-holding current flows through the first PTC element 211, the first PTC element 211 heats up and keeps the bimetal switch 203 in this state. To reset the system 201, a user (not shown) remove the fault condition and cut off the self-holding current through the first PTC element 211 by, for example, cutting off the power supply 101. Thereby, both the first PTC element 211 and the bimetal switch 203 cool down, and the bimetal switch 203 automatically returns to its normal position. In this way, the first PTC element 211 functions to control the status of the bimetal switch 203.

Figure 2B:
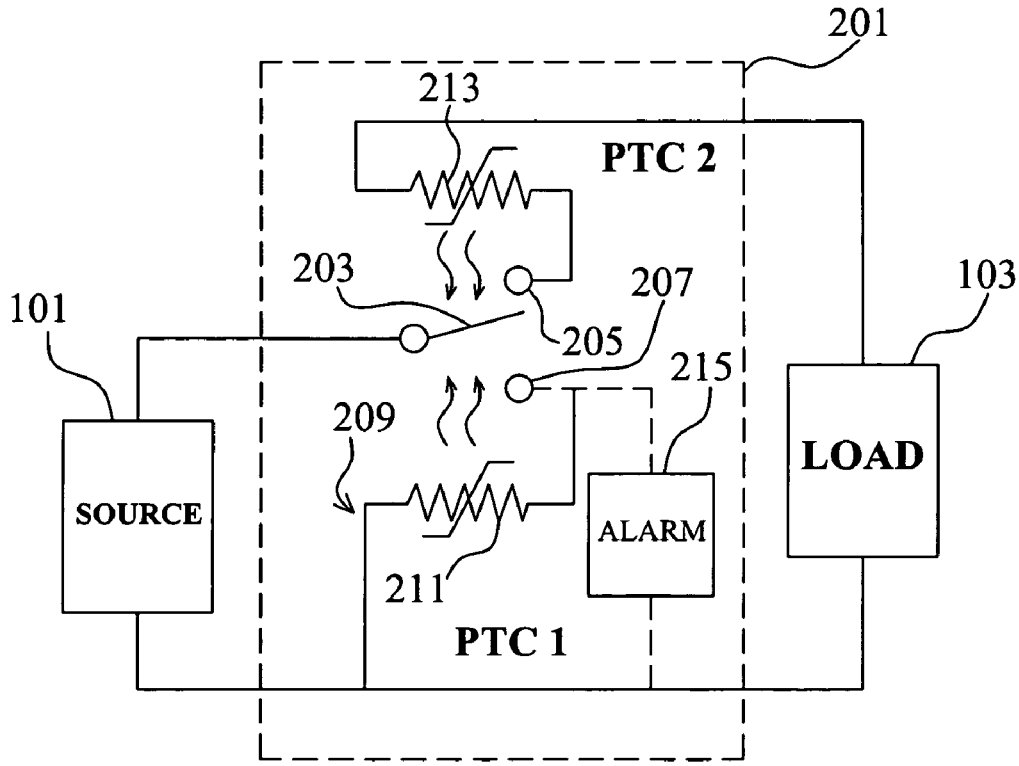
FIG. 2B is a diagram illustrating another exemplary electrical protection system according to the present invention.
Figure 3A:
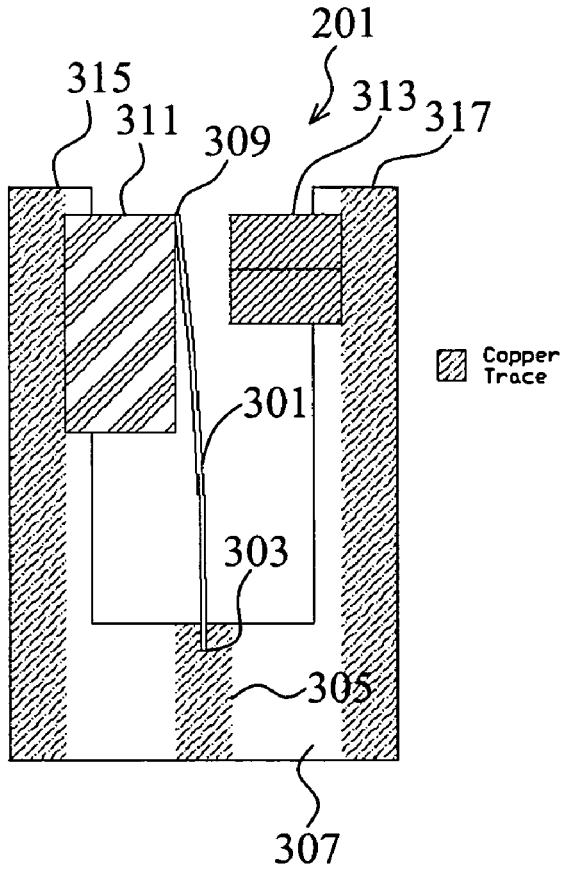
FIGS. 3A and 3B are top plan views illustrating the construction of the system of FIG. 2B in two states respectively.
Figure 3B:
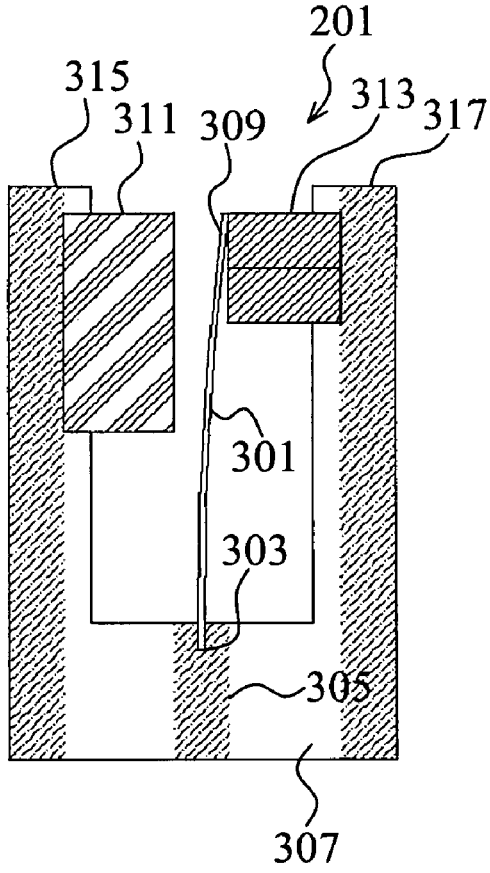
Figure 4A:
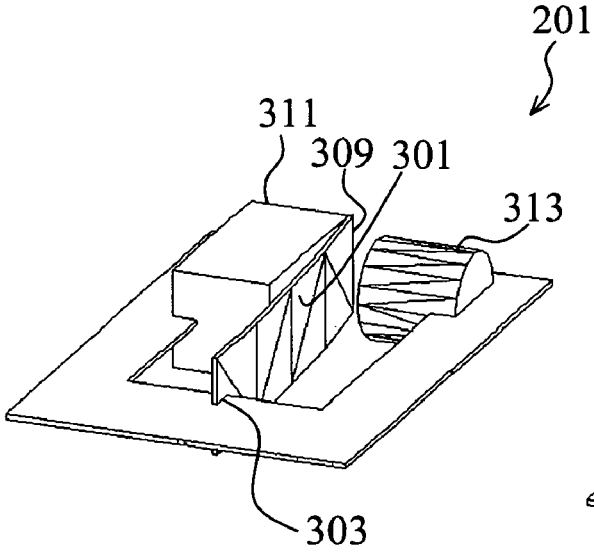
FIGS. 4A and 4B are perspective views illustrating the construction of the system of FIG. 2B in two states respectively.
Figure 4B:
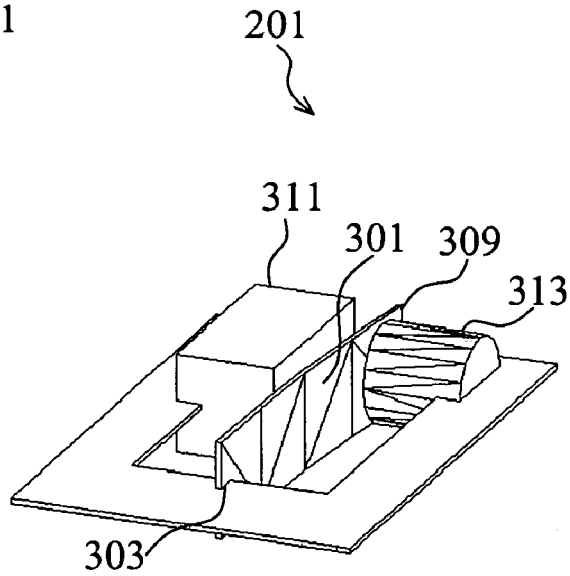

In another exemplary embodiment as illustrated in FIG. 2B, the electrical protection system 201 further includes a second PTC element 213 electrically connected in series between the electrical contact 205 and the load 103. The trip current value of the second PTC element 213 is smaller than the rated current of the bimetal switch 203. Therefore, when the current through the second PTC element 213, i.e., the operating current through the load 103 as well, is over its trip value, the second PTC element 213 begins to heat up and causes the bimetal switch 203 to change state, i.e., from the normal state to the fault state in which the switch 203 is switched to the electrical contact 207. In this exemplary embodiment, the second PTC element 213 is used to sense the over-current situation and the bimetal switch 203 is used to sense the over-temperature situation. The advantage of using a second PTC element 213 in series connection with the load 103 is that it can sense smaller current (as small as 0.1 ampere) than bimetal (a few amperes).

Construction of the electrical protection system of FIG. 2B is shown in FIGS. 3A, 3B, 4A and 4B. In general, a bimetal strip 301 is provided with one end 303 mounted to a copper trace 305 on a PCB board 307 for electrical connection with other parts of the system 201, and the other end 309 switchable between two PTC elements 311, 313 opposite to each other in two states respectively. The PTC elements 311, 313 are also mounted to two copper traces 315, 317 on the PCB board respectively for electrically connections with other parts and also function as the electrical contacts 205, 207 of FIG. 2B. Obviously, such a protection system has a simple construction and therefore can be easily implemented.

Various alternatives can be made to the exemplary embodiment as generally understood by the people in the art. For example, as shown by the dotted lines in FIGS. 2A and 2B, an alarm circuit 215 can be connected in parallel to the alternate path 209 such that when the switch 203 switches to the electrical contact 207, the alarm circuit 215 is triggered to alert the user.

What is claimed is:

1. An electrical protection system, which can be connected between an electrical power supply and an electrical load, comprising, a single switch switchable between a normal state in which the switch is electrically connected in series between the power supply and the load such that an operating current passes through the switch and the load, and a fault state in which the switch is electrically disconnected with the load at a single discontinuity such that no current passes through the load, wherein the switch switches to the fault state in an over-current or an over-temperature situation; and a controller operable in an open state when the switch operates in the normal state, in which state the controller is electrically disconnected from the power supply such that no current passes through the controller, or a closed state when the switch operates in the fault state, in which state the controller is electrically connected in series between the switch and the power supply such that a self-holding current passes through the switch and the controller, wherein the controller operates to automatically set the switch to the normal state when the self-holding current is off;

wherein the switch is a bimetal switch; and the controller includes a first PTC controller thermally coupled with the switch and the first PTC device is heated up under the self-holding current for keeping the switch in connection with the first PTC device.

2. The system of claim 1, wherein the first PTC device cools down as the self-holding current is off such that the switch is reset to its normal state.

3. The system of claim 1, further comprising an alarm circuit connected in parallel with the controller for sending an alarm signal when the switch switches to the fault state.

4. The system of claim 1, further comprising an over-current detection circuit being electrically connected in series connection between the switch and the load when the switch operates in the normal state, wherein the over-current detection circuit operates to set the switch to the fault state when the operating current passing through the over-current detection circuit exceeds a predetermined value.

5. The system of claim 4, wherein the over-current detection circuit includes a second PTC device thermally coupled with the switch.

* * * * *